US005714839A

United States Patent [19]

Chao

[11] Patent Number: 5,714,839

[45] Date of Patent: Feb. 3, 1998

[54] METAL HALIDE LAMP WITH REDUCED QUARTZ DEVITRIFICATION COMPRISING SODIUM, SCANDIUM, LITHIUM AND CESIUM IODIDES

[75] Inventor: Chung-Yao Chao, Lincoln, Mass.

[73] Assignee: Osram Sylvania Inc., Danvers, Mass.

[21] Appl. No.: 609,584

[22] Filed: Mar. 1, 1996

[51] Int. Cl.[6] ..... H01J 17/20; H01J 61/12; H01J 61/18

[52] U.S. Cl. ..... 313/571; 313/637; 313/638

[58] Field of Search ..... 313/571, 484, 313/490–93, 635, 636–38, 639–43, 229, 235, 575

[56] References Cited

U.S. PATENT DOCUMENTS

| | | | |
|---|---|---|---|
| Re. 30,831 | 12/1981 | Chalmers et al. | 313/229 |
| 3,761,758 | 9/1973 | Bamberg et al. | 313/229 |
| 3,979,624 | 9/1976 | Liu et al. | 313/229 |
| 4,678,960 | 7/1987 | Reiling | 313/25 |
| 4,801,846 | 1/1989 | Kramer et al. | 313/641 |
| 4,825,127 | 4/1989 | Krasko et al. | 313/638 |
| 5,021,703 | 6/1991 | Passmore et al. | 313/25 |
| 5,225,733 | 7/1993 | Krasko | 313/25 |
| 5,225,738 | 7/1993 | Ramaiah et al. | 313/641 |
| 5,363,007 | 11/1994 | Fromm et al. | 313/25 |

*Primary Examiner*—Ashok Patel
*Assistant Examiner*—Mark Haynes
*Attorney, Agent, or Firm*—William H. McNeill

[57] ABSTRACT

An arc tube for a high intensity discharge lamp. The arc tube has a hermetically sealed body formed from a vitreous material subject to devitrification, at least two oppositely disposed electrodes are sealed in the body. An are generating and sustaining medium is provided in the body and operates to produce visible light when an electric current is applied to the electrodes. The are tube has a given color rendering index, and at least a portion of the medium comprises a color correcting component of lithium iodide which contributes no only to the given color rendering index but which also acts as a devitrification agent. The improvement comprises an anti-devitrification component in the medium, the anti-devitrification component having a minimal detrimental effect on the given color rendering index while increasing the life of the are tube.

1 Claim, 2 Drawing Sheets

METAL HALIDE LAMP WITH REDUCED QUARTZ DEVITRIFICATION COMPRISING SODIUM, SCANDIUM, LITHIUM AND CESIUM IODIDES

TECHNICAL FIELD

This invention relates to metal halide arc tubes and more particularly to such metal halide arc tubes having an extended life by virtue of being less susceptible to devitrification of the arc tube body.

BACKGROUND ART

Adding lithium to a sodium/scandium iodide mixture in a metal halide arc discharge lamp is a known technique for improving the color rendering index (CRI) of the lamp. However, the arc tubes of such lamps are frequently made of fused silica, a thermodynamically unstable material that will, over time, turn into a crystalline silica by the process known as devitrification. Devitrified silica has low light transmission and is also prone to cracking, a clearly undesirable feature in a high intensity metal halide arc discharge lamp.

The devitrification kinetics of fused silica depends strongly on the temperature and the presence of certain chemicals, such as alkali ions and moisture. All metal halide lamps have at least one alkali ion (Na) and, as noted above, others contain a given amount of lithium to enhance the CRI. It has been discovered that lithium as an additive to a sodium/scandium arc tube fill will contribute to a life-shortening devitrification of fused silica.

DISCLOSURE OF INVENTION

It is, therefore, an object of this invention to obviate the disadvantages of the prior art.

It is another object of the invention to increase the life expectancy of metal halide arc discharge lamps.

It is yet another object of the invention to increase the time interval leading to devitrification of fused silica arc tubes.

These objects are accomplished, in one aspect of the invention, by the provision of an arc tube for a high intensity discharge lamp wherein the arc tube has a hermetically sealed body formed from a vitreous material subject to devitrification and includes at least two oppositely disposed electrodes sealed in the body. An arc generating and sustaining medium in the body operates to produce visible light when an electric current is applied to the electrodes. The arc tube has a given color rendering index and at least a portion of the medium comprises lithium iodide as a color correcting component which contributes to the given color rendering index and further acts as a devitrification agent. It has been discovered that an anti-devitrification component can be added to the medium with minimal detrimental effect on the given color rendering index while increasing the life of the arc tube by slowing the devitrification process.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 5:
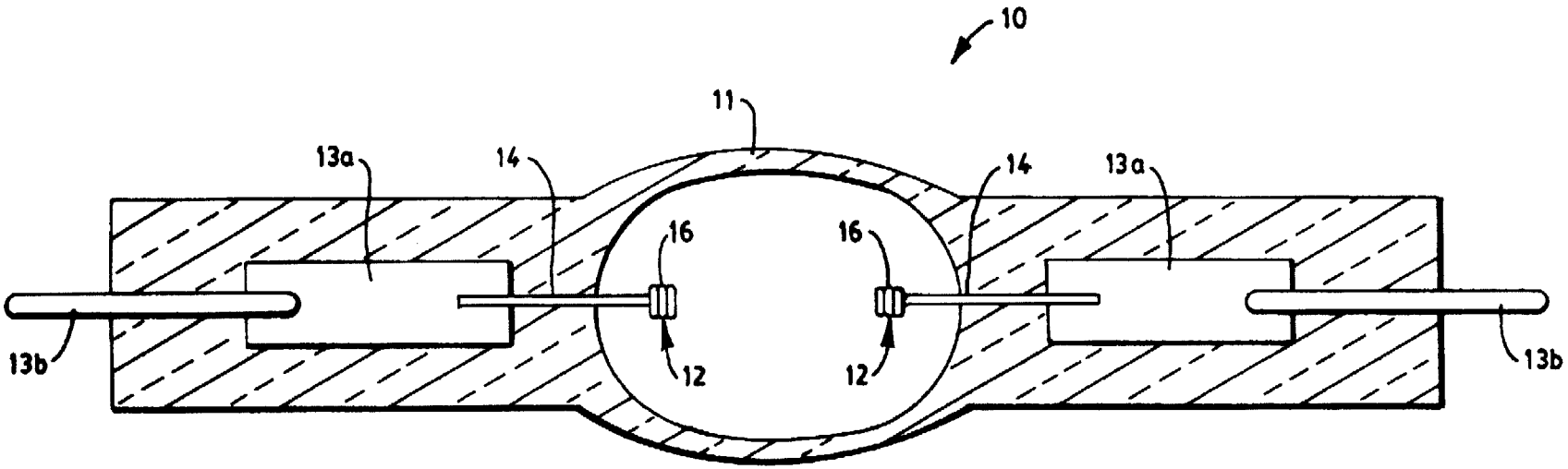
FIG. 5 is an elevational, sectional diagrammatic view of an arc tube.

Referring now to the drawings with greater particularity, there is shown in FIG. 5 an arc tube 10 for a high pressure discharge lamp. The arc tube 10 has a vitreous silica glass envelope 11 sealed in a vacuum-tight manner and containing an arc generating and sustaining medium therewithin. Vitreous silica is a glass composed essentially of $SiO_2$. It is used where high temperature operation and excellent chemical stability are required. It has high resistance to severe thermal shock, high transmittance to ultra violet, visible and infrared radiation and excellent electrical properties. However, due to its low coefficient of thermal expansion, it cannot be tempered to increase mechanical strength. Depending on the method of manufacture, this glass may be known as fused silica, synthetic fused quartz, or fused quartz. All of these terms may be used interchangeably herein. Cathodes 12 are connected to current supply conductors 13*a*, which are usually formed of molybdenum foil, and which project beyond the envelope 11 by means of conductors 13*b*, which can be formed of tungsten. A cathode core 14, usually also formed of tungsten, projects inside the envelope and has a coil 16 affixed thereto.

The arc tube 10 has a wall thickness of 1 mm and a volume of 2 cc. The chemical fill consists essentially of 13 to 20 mg of sodium, scandium and lithium iodides in a weight ratio of 68:8:24. Mercury is present in an amount of about 16 to 18 mg. This fill provides a lamp having a color temperature in the range of 3000° K. when operating. It is frequently denominated a 3 K lamp.

As noted above, lamps employing alkali ions are subject to devitrification. The addition of lithium iodide, which is a necessary component to achieve a desired CRI between 72 and 77 in a 3 K lamp, contributes to this devitrification.

In FIGS. 1–4 a prior art lamp containing the 68:8:24 sodium, scandium, lithium fill (hereinafter a 3K fill) is used as a control and is plotted as graph A. Two embodiments of the invention are plotted as graphs B and C. In the lamp of graph B, the fill additionally contains cesium iodide in the amount of 5% by weight of the 3 K fill and in the lamp of graph C the fill additionally contains cesium iodide in the amount of 10% by weight of the 3 K fill.

Figure 1:
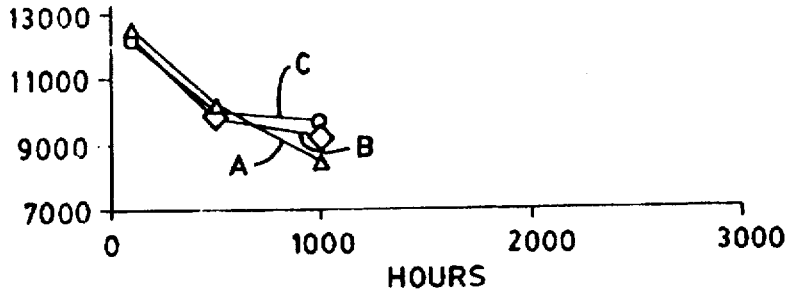
FIG. 1 is a graph of lumen output comparing a control and two embodiments of the invention.
Figure 2:
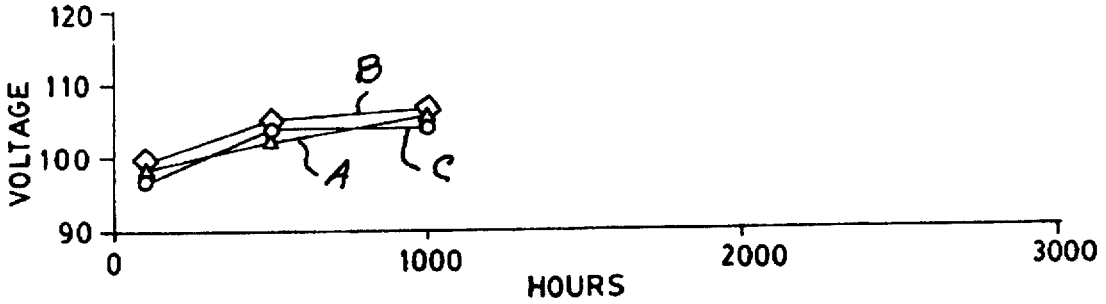
FIG. 2 is a similar graph depicting voltage.
Figure 3:
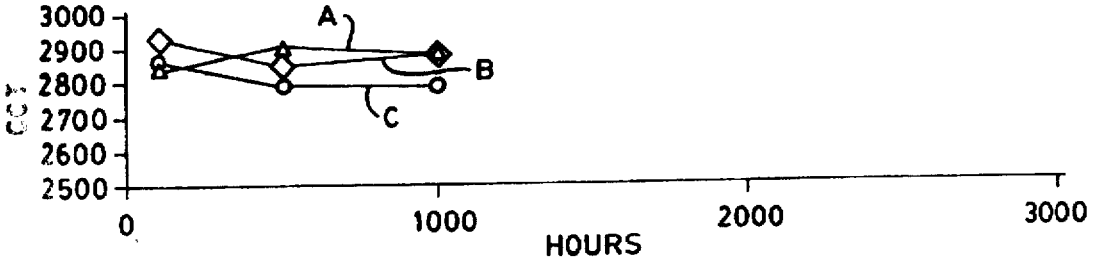
FIG. 3 is a similar graph comparing the color corrected temperature (CCT) of a control and the two embodiments of the invention.
Figure 4:
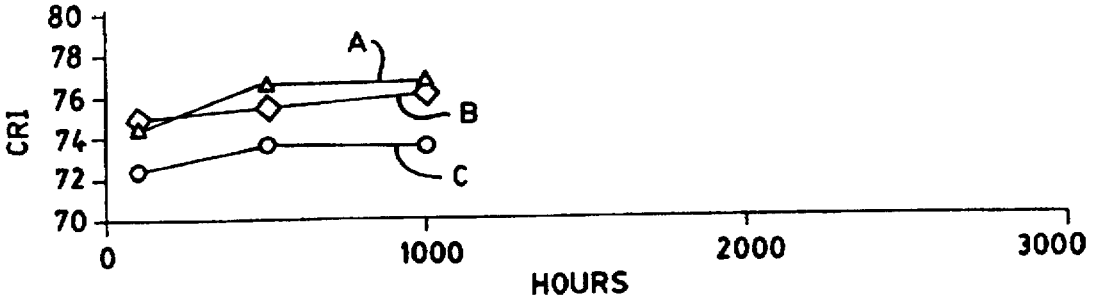
FIG. 4 is a similar graph illustrating respective color rendering indices (CRI)

Referring particularly to FIG. 1, it will be seen that the lamps containing the cesium iodide show a marked decrease in the devitrification process after about 500 hours, as attested to by the greater lumen output of the cesium containing lamps relative to the control. The voltage rise after 1000 hours is virtually the same for the cesium lamps, as is the CCT (FIG. 3). For the lamp of graph B (the lamp with 5% cesium) the 1000 hour data are substantially identical with the control and the CRI data for both the 5% and 10% cesium addition (see FIG. 4) are well within acceptable limits when considered with the increase in life of the arc tube.

Therefore, there is here provided an arc tube having increased life by virtue of the slowdown of the devitrification process, the increase in life being accomplished without any detrimental decrease in the CRI of an established lamp type.

While there have been shown an described what are at present considered the preferred embodiments of the invention, it will be apparent to those skilled in the art that various changes and modifications can be made herein without departing from the scope of the invention as defined by the appended claims.

What is claimed is:

1. In an arc tube for a high intensity discharge lamp, said arc tube having a hermetically sealed body formed from fused silica subject to devitrification; at least two oppositely disposed electrodes sealed in said body; an arc generating and sustaining medium consisting essentially of sodium iodide, scandium iodide and lithium iodide in a weight ratio of 68:8:24 in said body operating to produce visible light when an electric current is applied to said electrodes whereby said arc tube has a given color rendering index, at least a portion of said medium comprising a color correcting component of said lithium iodide which contributes to said given color rendering index and which also acts as a devitrification agent, the improvement comprising: an anti-devitrification component consisting of cesium iodide in an amount of 5% to 10% by weight of said medium in said medium, said anti-devitrification component having a minimal detrimental effect on said given color rendering index while increasing the life of said arc tube.

* * * * *